United States Patent [19]

Brown

[11] Patent Number: 4,635,362

[45] Date of Patent: Jan. 13, 1987

[54] CUTTING APPARATUS

[76] Inventor: Barry D. Brown, 4550 Sierra Madre Dr., Reno, Nev. 89502

[21] Appl. No.: 759,515

[22] Filed: Jul. 26, 1985

Related U.S. Application Data

[63] Continuation of Ser. No. 608,140, May 8, 1984, abandoned.

[51] Int. Cl.[4] ..... B26D 7/02

[52] U.S. Cl. ..... 30/124; 30/294; 83/455

[58] Field of Search ..... 83/453, 459, 462, 454, 83/455, 452, 464, 614, 560, 633; 30/124, 286, 289, 294

[56] References Cited

U.S. PATENT DOCUMENTS

| | | | |
|---|---|---|---|
| 197,901 | 12/1877 | Sargent | 83/614 X |
| 513,851 | 1/1894 | Wheeler | 83/452 |
| 556,369 | 3/1896 | Price | 83/452 |
| 684,035 | 10/1901 | Atherton | 83/454 |
| 1,235,459 | 7/1917 | Gaffney | 83/455 |
| 2,013,894 | 9/1935 | Olsen | 30/294 X |
| 2,327,223 | 8/1943 | Silver | 83/459 |
| 3,301,117 | 1/1967 | Spaulding | 83/455 |
| 3,576,148 | 4/1971 | Katz | 30/392 |
| 3,862,495 | 1/1975 | Markert | 30/294 |
| 4,096,631 | 6/1978 | Ward | 30/294 |
| 4,509,397 | 4/1985 | Mori | 83/453 |

*Primary Examiner*—Jimmy C. Peters

[57] ABSTRACT

Apparatus is disclosed for cutting a sheet using a hand-held knife. The apparatus includes a cutting table and a clamp having a gripping edge for holding the sheet against the cutting table. The clamp provides freely accessible lateral guides for locating the cutting blade close to the sheet-gripping edge and for orienting the cutting blade and the axis of the knife handle in a near-vertical plane.

11 Claims, 5 Drawing Figures

CUTTING APPARATUS

This application is a continuation of application Ser. No. 608,140 filed May 8, 1984, now abandoned.

The present invention relates to apparatus for cutting sheets, especially copper foil.

In an application of the invention, a strip of copper foil is to be cut for use as a conductor to repair or to construct a printed circuit. The present invention provides apparatus for cutting such strips quickly and accurately, without resort to cumbersome apparatus, or to apparatus that is rendered impractical for the purpose because of complexity and high cost.

The illustrative apparatus detailed below and shown in the accompanying drawing has a cutting table and a clamp for holding a sheet in place on the cutting table. The clamp provides an elongated element having an edge to grip the sheet against the cutting surface and a closely adjacent edge that guides the blade of a hand-held knife along the gripped sheet as the cut is being made. The apparatus includes a lateral guide surface for the knife handle, spaced from the cutting surface and parallel to the blade-guiding edge, for maintaining the attitude of the blade constant as the cut is being made, ideally in a vertical plane. In the exemplary apparatus, the lateral guide surface for the knife handle is provided by the clamp. The knife-handle guide and the blade-guiding edge are freely accessible for enabling the user to place the knife in cutting position expeditiously and for enabling the user to maintain uniform control of the blade as the cut is being made.

The nature of the invention, including the foregoing aspects and others, will be more fully appreciated from the following description of an illustrative embodiment that is shown in the accompanying drawings.

Figure 1:
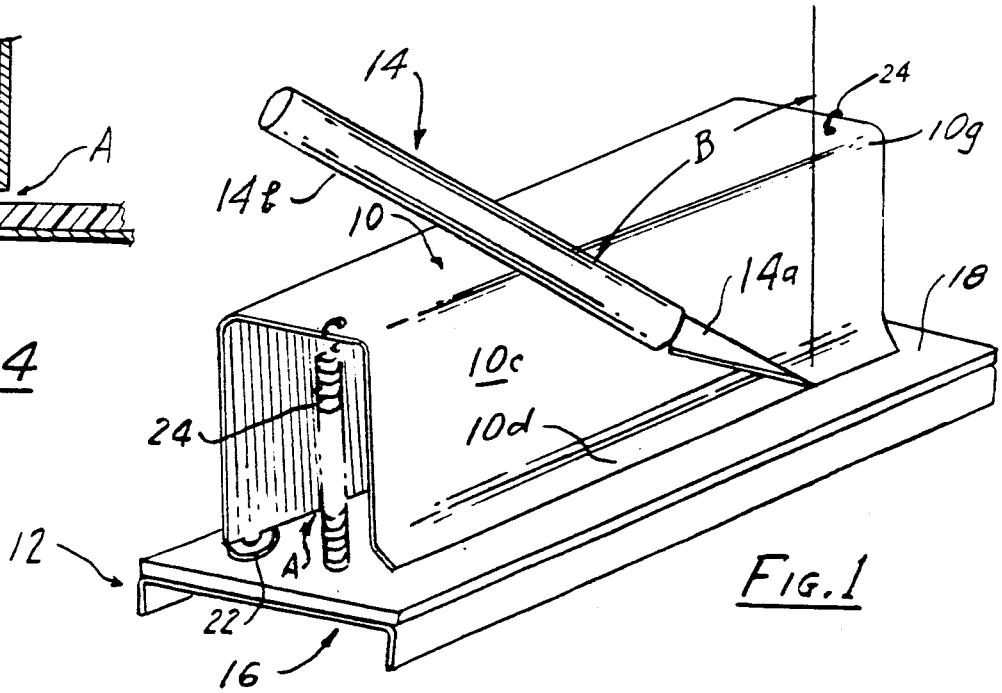
FIG. 1 is a perspective view of the novel cutting apparatus as an exemplary embodiment of the invention.

In FIG. 1, clamp 10 on cutting table 12 is an elongated member that serves the several purposes of guiding the blade and the handle of a knife 14 while holding a sheet being cut (not shown) securely in place on the cutting table.

Cutting table 12 includes a base 16 of sheet-metal. Base 16 is a shallow channel having narrow walls **16*a* and a broad web 16*b*. A plate 18 of plastic on web 16*b*** provides an exposed normally horizontal cutting surface.

Clamp 10 consists of an inverted sheet-metal channel narrower than the channel of base 16, having rear, top and front walls **10*a*, 10*b* and 10*c*, respectively. A marginal portion 10*d*** of the front wall slopes downward and forward.

Two tabs 20 extend down from the rear wall **10*a*, these tabs being integral portions of the sheet-metal channel 10. Each tab 20 extends down through a spacing washer 22, through a slot in plastic plate 18, and through a slot in base 16. Tabs 20 are twisted below sheet-metal base 16 so that clamp 10 is secured in assembly to table 12. Tabs 20 locate clamp 10 on table 12, yet are loose in their slots to allow clamp 10 to tilt variably. Tabs 20 and the slots in base 16** are cooperating hinge couples.

Figure 2:
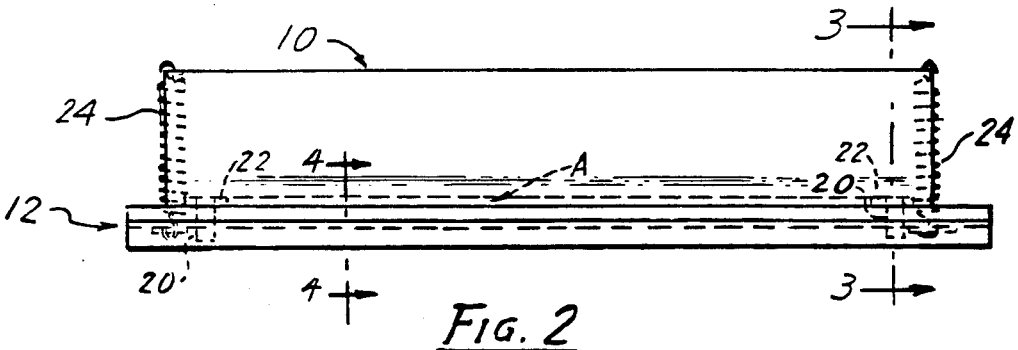
FIG. 2 is a front view of the novel cutting apparatus, omitting the knife shown in FIG. 1.
Figure 3:
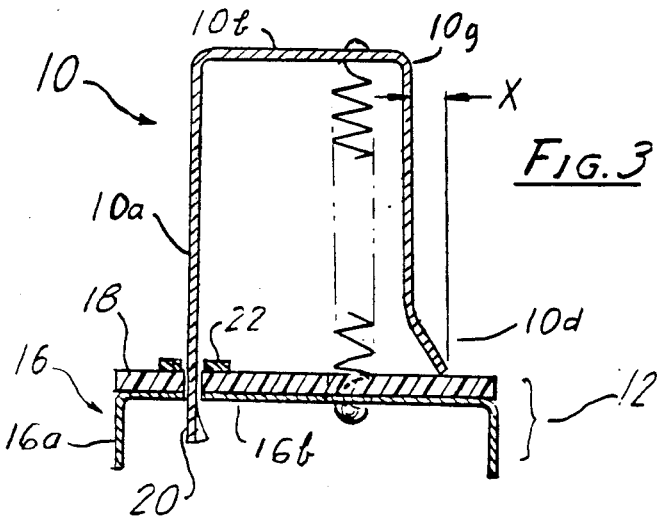
FIG. 3 is a cross-section of the apparatus of FIG. 2 at the plane 3—3, drawn to larger scale.

Washers 22 (FIG. 3) insure a space A (FIG. 4) between the lower edge of rear wall **10*a* of the clamp and the upper surface of plate 18** of the cutting table. That space serves as a passage through which a sheet may extend under the clamp and on the cutting table.

Tension coil springs 24 at the ends of clamp 10 bias the clamp downward about its lower rear portion for clamping a sheet in position to be cut. Two parallel edges 26 and 28 are formed at respective corners where the opposite parallel surfaces of the sheet metal are intersected by the transverse surface that forms the margin of the sheet-metal. That transverse surface slants relative to the table.

Figure 5:
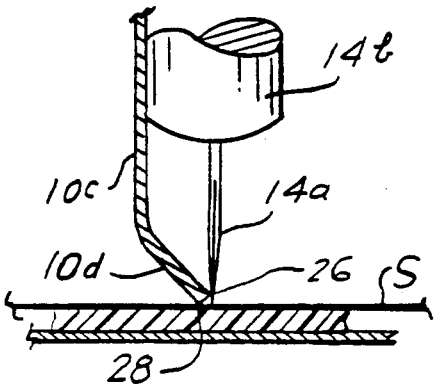
FIG. 5 is an enlarged fragmentary end view of the apparatus of FIG. 1, partly in cross-section.

Clamp 10 serves several purposes. Edge 26 (FIG. 5) is a guide for the blade **14*a* of knife 14. Edge 28 is a gripper that develops sharply localized pressure against a sheet, to hold the sheet flat and securely against the cutting surface all along cutting guide edge 26. Corner 26 projects outward relative to corner 28, as an overhang, due to the slope or slant of the marginal surface of the sheet metal. This apparatus is particularly useful for cutting narrow strips from a sheet of copper foil, for use as add-on portions of a printed circuit. Thin copper foil could be deformed as it is being cut. However, edges 26 and 28 are close to each other, here being part of a straight margin of sloping wall portion 10*d***. Accordingly, the material being cut is held securely against the cutting surface all along the cut being made.

A further purpose of clamp 10 is as a guide for knife-handle **14*b*. The form of knife shown is widely available, being used by model makers and in art work. It has a renewable blade held by a clamp, and it has a cylindrical handle. The knife is held by the user so that the knife-handle is pressed laterally against the side wall 10*c* of the clamp while blade 14*a* presses against guide edge 26. The prominently sloping wall portion 10*d* provides an off-set X (FIG. 3) between guide edge 26 (FIG. 5) and wall portion 10*c*** of the clamp against which the knife-handle is held as the sheet S is being cut.

The knife shown has a cylindrical handle, and the off-set X between the plane of wall portion **10*c* and a parallel plane containing knife-blade guide 26 is one-half the diameter of the knife-handle. The axis of the knife is in the plane of the blade, which, here, is truly perpendicular to the cutting surface. The axis of the handle is ordinarily held at a slant angle B in the vertical plane, as shown, for optimum cutting results. The user might change the slant angle of the knife-handle axis during a cutting stroke. However, because the handle of the knife is cylindrical and it is held against the flat near-vertical wall portion 10*c*, there is no appreciable change in the upright disposition of blade 14*a* against guide edge 26 even if the tilt angle of the knife-handle should vary as a cut is being made. This relationship represents an ideal condition for producing a cleanly cut strip, as narrow as 1/64" wide. Even if the knife-handle were not cylindrical, a portion of the knife handle can be guided along a guide surface 10*g* that is spaced from the cutting surface (FIGS. 3 and 5**) for maintaining the basic attitude of the knife blade constant during the cutting stroke.

In an example, the knife-handle has a diameter of 5/16 inch and off-set X is 5/32 inch. In this example, guide surface 10*g* is 1⅛ inch from the cutting surface.

Figure 4:
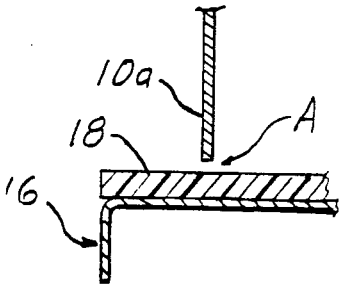
FIG. 4 is an enlarged fragmentary cross-section of the apparatus of FIG. 2 at the plane 4—4.

Clamp 10 is tilted about the hinging tabs 20 to raise edge 28 away from plate 18, in preparation for sliding a sheet S into place. The sheet normally extends through passage or gap A (FIG. 4). Springs 24 then cause clamp 10 to hold the sheet in a desired adjusted position on plate 18. The person who grips the knife in making a cut can augment the clamping pressure on clamp 10 manually.

The top 10*b* of clamp 10 is parallel to the cutting surface and it is adjacent knife-handle guide 10*c*. This relationship has proved to be extremely useful. There is a natural tendency for the user to grasp the knife handle with three fingers, the thumb, the index finger and the middle finger. The index finger bears largely down on the knife handle, producing cutting pressure. The middle finger holds the knife blade against guide edge 26 and in addition presses the knife handle against the guide surface 10*c* that is vertical, perpendicular to the cutting surface. The user's thumb both grips the knife handle and glides along the top surface 10*b* adjoining the knife-handle guide 10*c*. In this way the user's knife-operating hand (1) presses down on the clamp, augmenting the grip of edge 28 against the sheet S; (2) presses the knife against the lateral knife-handle guide surface 10*c* and against the blade guide 26; and (3) glides along surface 10*b*. The natural effect is to enable the user to maintain a constant attitude of the blade in relation to the sheet being cut, both by keeping the plane of the blade at a constant angle (here, perpendicular) to the sheet and by avoiding rotation or twisting of the knife handle about its longitudinal axis. If such twisting were to occur as the cut progresses, the cutting edge would shift toward or away from the guide edge 26, making the cut correspondingly non-uniform. This does not occur in practice even when a person uses the apparatus after only minimal experience.

Where easily deformed material is being cut, notably copper foil, it is highly desirable for the clamp to grip the sheet close to the cutting edge throughout the cutting stroke. Here, the sheet gripping edge is straight, and because the sheet-gripping edge is part of the relatively wide sheet-metal 10*c*-10*d*, actually being a part of the channel 10*a*-10*b*-10*c*-10*d*, gripping edge 28 retains its straightness while downward pressure is exerted on the clamp. The cutting table, too, is flat and extremely stiff. Accordingly, clamp 10 exerts pressure all along gripping edge 28.

Secure gripping of the sheet is enhanced by virtue of pressure exerted on surface 10*b* by the hand that holds the knife, pressure that moves along the clamp as the cut progresses.

The apparatus as thus far described is highly effective for its purpose. As a further contributing feature, sheet gripper 28 is in the form of a sharp corner. As such, it guards against sheet S sliding as the cut is being made. The pressure available to hold the sheet in place is distributed all along the length of clamp 10. Clamping edge 28 is formed as a corner, a sharp corner. Its sharpness is enhanced by shearing the sheet metal that forms wall portion 10*d* so that the burr inherently produced in the shearing operation develops at edge 28 rather than at edge 26.

Knife-guide edge or corner 26 is spaced from sheet-gripping edge or corner 28 only by the thickness of the sheet metal, 0.04 inch thick in an example. The closeness of edges 26 and 28 contributes to the straightness and the uniformity of the cut, minimizing the consequence of any slight variations that might occur in the attitude of the knife as the cut progresses.

Blade guide 26 is spaced from the plane where gripping edge 28 bears on sheet S. This provides a guide for a side surface of the blade and avoids the blade "climbing" onto the blade guide. As a detail, it will be noted that sheet-gripping edge 28 is recessed slightly away from blade-guide 26 and from the cut being formed.

It would be feasible to use a knife whose handle is not cylindrical. For example, the handle could have a flat that bears against portion 10*g* along the upper margin of clamp portion 10*c*. Similarly, the handle could be slender near blade 14*a* and it could be larger in diameter where it engages guide portion 10*g*. In that event, slant angle B of the knife axis should be maintained constant as the cut is being made to preclude slight inaccuracy due to changes in the attitude of the side planes of the blade 14*a* that might occur otherwise.

The described cutting apparatus is economical to produce and easy to use with excellent accuracy. The sheet to be cut is easily positioned and held in position as it is cut; and the knife is quickly moved into place and easily operated accurately as an inherent characteristic of the apparatus. Because of its high accuracy and its simplicity and low cost, the novel apparatus is a practical device where more complex and cumbersome apparatus might be impractical because of complexity and high cost.

It would be possible to provide a guide portion 10*g* as a rail fixed to table 12, parallel to movable guide and clamping edges 26, 28. Such an alternative would achieve most of the purposes of the described apparatus. However, the described apparatus in the drawings is easier to manipulate, as in applying manual effort to the sheet-securing clamp during the cutting operation.

The novel apparatus provides a hand-held knife whose blade can be placed quickly against an elongated element that comprises close-spaced parallel edges providing a blade guide and a sheet-clamp; and both the knife handle and the user's knife-holding hand are guided parallel to the elongated element as the cut is being made. The complexity and high cost of a fixture for clamping a cutter and a fixture-guiding track are avoided.

The illustrative embodiment of the invention described above and shown in the accompanying drawings is subject to varied modification and rearrangement by those skilled in the art. Consequently, the invention should be construed broadly in accordance with its true spirit and scope.

What is claimed is:

1. Apparatus for making accurate elongated cuts in a sheet, including a table for supporting a sheet to be cut and an elongated member above said table, and a knife having a knife handle and a knife blade projecting from an end of the knife handle, said blade having a cutting edge at its end and having opposite side faces, said elongated member having an elongated marginal portion constituting means for clamping a sheet against said table and for directly guiding a side face of the knife blade, said table providing a cutting surface that supports a sheet directly opposite to said blade when guided by said elongated marginal portion, and a pair of hinge couples supporting said elongated member on said table for arcuate movement of said elongated marginal portion toward and away from the table about an axis parallel to but spaced from said elongated marginal portion, said hinge couples being mutually spaced apart along said axis and at least a portion of said elongated member between said hinge couples being spaced from the table so as to provide a passage between the hinge couples, over the table and under the elongated member for a sheet to be cut, and spring means acting between said elongated member and said table and disposed out of said passage for biasing said elongated marginal portion toward said table.

2. Apparatus as in claim 1 wherein said spring means comprises a pair of spring devices mutually spaced apart and disposed at opposite sides of said passage.

3. Apparatus as in claim 1, wherein said elongated member has an elongated side portion for guiding said knife handle, said elongated side portion being spaced from said table and extending parallel to said elongated marginal portion, said knife and said elongated member being proportioned in relation to each other for enabling a user of the knife to place and guide the knife handle against said elongated side portion and concurrently to place and guide a side of the knife blade against and along said elongated marginal portion with the guided side of the knife blade essentially perpendicular to the cutting surface, said apparatus being free of obstruction preventing the user from placing and guiding said knife handle and said knife blade as aforesaid and being free of obstruction interfering with a range of slant adjustment of the knife handle while a side of the blade is held against said elongated marginal portion.

4. Apparatus as in claim 3, wherein said knife handle is cylindrical, said elongated marginal portion and said elongated side portion of said elongated member being in respective first and second parallel planes essentially perpendicular to said cutting surface and offset from each other by essentially one-half of the diameter of the knife handle for disposing the axis of the cylindrical knife handle in said second plane.

5. Apparatus as in claim 3 wherein said elongated member has a further elongated top portion parallel to said elongated side portion and so located in proximity to said side portion as to guide the hand of a user that grasps the knife handle, for enabling the user to augment the clamping spring bias of the elongated marginal portion against a sheet and for guiding the user's hand in placing and maintaining the knife with the axis of its handle in a plane perpendicular to the cutting surface and at a stable slant angle in relation to the cutting surface intially and during guided movement of the knife along the elongated member.

6. Apparatus as in claim 1, wherein said spring means comprises a pair of tension springs acting on said elongated member between said hinge couples, respectively, and said elongated marginal portion.

7. Apparatus as in claim 1, wherein said elongated member is of sheet metal and said elongated marginal portion comprises two elongated corners formed by opposite parallel surfaces of said sheet metal intersection a transverse marginal surface of the sheet metal, a first one of said corners being directed toward said table for developing localized clamping pressure against a sheet and the other of said corners over-hanging the first corner for guiding engagement with the knife blade.

8. Apparatus for making accurate elongated cuts in a sheet, including a table for supporting a sheet to be cut and an elongated member above said table, and a knife having a knife handle and a knife balde projecting from an end of the knife handle, said blade having a cutting edge at its end and having opposite said faces, said elongated member having an elongated marginal portion constituting means for clamping a sheet against said table and for directly guiding a side face of the knife blade, said table providing a cutting surface that supports a sheet directly opposite to said blade when guided by said elongated marginal portion, hinge means having an axis parallel to but spaced from said elongated marginal portion of said elongated member for supporting said elongated member over the table so that the elongated marginal portion of the elongated member is movable toward and away from the table to grip and release a sheet, and spring means for biasing said elongated marginal portion toward the table so as to hold a sheet in position in preparation for cutting, the elongated member having an elongated side portion constituting means for guiding said knife handle, said elongated side portion being spaced from said table and extending parallel to said elongated marginal portion, said knife and said elongated member being proportioned in relation to each other for enabling a user of the knife to place and guide the knife handle against said elongated side portion and concurrently to place and guide the knife blade against and along said elongated marginal portion with the knife blade aligned with a plane perpendicular to said cutting surface in cutting a sheet, said apparatus being free of obstruction preventing the user from placing and guiding said knife handle and said knife blade as aforesaid.

9. Apparatus as in claim 8 wherein said elongated member has a further elongated top portion parallel to said elongated side portion and so located in proximity to said side portion as to guide the user's hand while grasping the knife handle, for enabling the user to augment the clamping spring bias of the elongated marginal portion against a sheet and for enabling the user to establish and maintain the axis of the knife handle in a plane perpendicular to the cutting surface and at a stable slant angle in relation to the cutting surface initially and during guided movement of the knife along the elongated member.

10. Apparatus for cutting a strip from the edge of a sheet, including a sheet-supporting table providing a cutting surface, a clamp overlying the cutting surface, and a knife having a knife-handle and a blade projecting from an end of the knife-handle, said clamp having an elongated element movably supported over the cutting table and constituting an elongated blade guide and an elongated gripper closely adjacent to the knife-blade guide for holding a sheet against the cutting table, said clamp having an elongated side portion extending parallel to said elongated element and spaced from the cutting table, said elongated side portion constituting means for guiding said knife-handle, both said blade guide and said knife-handle guide being freely accessible for lateral engagement by said blade and said knife-handle, respectively, enabling a person to produce a long and accurate cut in a sheet gripped by said clamp by moving the knife along the clamp while holding a face of the blade against the blade guide and holding the knife-handle against said knife-handle guiding means for maintaining a uniform attitude of the knife in relation to the cutting table, said clamp and said cutting table having a pair of mutually cooperating hinge formations spaced apart from each other along a line spaced from and essentially parallel to said elongated element, at least a portion of said clamp between said spaced-apart hinge formations being spaced from said cutting table so as to provide a passage between said hinge formations for a sheet that is to be cut, further including a pair of tension coil springs for biasing the elongated element of the clamp against a sheet on the cutting clamp against a sheet on the cutting surface, said springs being mutually spaced apart along the clamp and disposed approximately opposite said hinge formations.

11. Apparatus for cutting a strip from the edge of a sheet, including a knife having a knife handle and a knife blade extending from an end thereof, a sheet-supporting table providing a flat cutting surface, an elongated member movably supported by the table and spring-biased toward the table, said elongated member being of sheet metal including an elongated marginal portion that has first and second parallel straight corners formed by opposite parallel surfaces of the sheet metal intersected by a transverse marginal surface of the sheet metal, said transverse marginal surface slanting in relation to the table with said first corner disposed to apply sharply localized pressure along its length for gripping a sheet on the table and with the second corner constituting an overhang that projects from said elongated member outward of said first corner, said second corner being a guide for said knife blade extending parallel to said first corner, said elongated member being a single stiff member including, in addition to said marginal portion, an elongated portion spaced from said first and second corners and parallel thereto for guiding the knife handle and the hand of a user gripping the knife handle in making a cut, for enabling the user to maintain a uniform attitude of the knife in relation to the table and to apply downward pressure to said elongated member and thereby to cause said first corner to develop firm sheet-clamping pressure distributed along its length.

* * * * *